US011680425B2

(12) United States Patent
Marsden

(10) Patent No.: US 11,680,425 B2
(45) Date of Patent: Jun. 20, 2023

(54) MAGNET RESPONSIVE CABINET LOCK

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 449 days.

(21) Appl. No.: 16/575,361

(22) Filed: Sep. 18, 2019

(65) Prior Publication Data

US 2021/0079689 A1 Mar. 18, 2021

(51) Int. Cl.

| | |
|---|---|
| ***E05B 47/00*** | (2006.01) |
| ***E05B 63/18*** | (2006.01) |
| ***A47B 88/57*** | (2017.01) |
| ***E05C 1/00*** | (2006.01) |
| ***E05B 65/46*** | (2017.01) |

(52) U.S. Cl.

CPC ..... *E05B 47/0038* (2013.01); *A47B 88/57* (2017.01); *E05B 47/0045* (2013.01); *E05B 65/46* (2013.01); *E05C 1/004* (2013.01); *E05B 63/18* (2013.01); *E05Y 2900/20* (2013.01)

(58) Field of Classification Search

CPC ..... E05B 47/0038; E05B 47/004; E05B 47/0045; E05B 63/18; E05B 65/46; E05B 65/44; E05B 65/0014; E05C 1/00; E05C 1/004; E05C 1/08; E05C 1/085; E05C 1/12; E05C 1/14; E05C 19/18; A47B 88/50; A47B 88/57; Y10T 292/0971; Y10T 292/11; Y10T 292/34; Y10T 292/37; Y10T 292/379; Y10T 292/388; Y10S 292/65

See application file for complete search history.

(56) References Cited

U.S. PATENT DOCUMENTS

| | | | | |
|---|---|---|---|---|
| 5,188,405 | A | 2/1993 | Maccaferri | |
| 5,360,243 | A | 11/1994 | Hirsh | |
| 5,485,733 | A | 1/1996 | Hoffman | |
| 6,000,735 | A | 12/1999 | Jourdenais | |
| 6,079,755 | A * | 6/2000 | Chang | E05B 47/0002 292/144 |
| 7,234,739 | B2 | 6/2007 | Saitoh et al. | |
| 7,934,780 | B2 | 5/2011 | McBroom et al. | |
| 8,397,546 | B2 | 3/2013 | Varney et al. | |

(Continued)

FOREIGN PATENT DOCUMENTS

| | | | | |
|---|---|---|---|---|
| CN | 101597984 A | * 12/2009 | | E05C 1/12 |
| EP | 0 098 899 A1 | 1/1984 | | |

(Continued)

OTHER PUBLICATIONS

Machine translation of KR 20100050897 A (Year: 2013).*

(Continued)

*Primary Examiner* — Christine M Mills
*Assistant Examiner* — Peter H Watson
(74) *Attorney, Agent, or Firm* — Wolf, Greenfield & Sacks, P.C.

(57) ABSTRACT

A cabinet lock includes a latch configured to translate between extended and retracted positions and a lever configured to rotate between engaged and disengaged positions. The latch may be coupled to the lever with a pin in a corresponding slot. When the lever is in the disengaged position the latch may be in the extended position and when the lever is in the engaged position the latch may be in the retracted position. The lever includes a ferromagnetic portion responsive to a magnet within a threshold distance, where the presence of the magnet moves the lever to the engaged position.

26 Claims, 7 Drawing Sheets

(56) References Cited

U.S. PATENT DOCUMENTS

| | | | | |
|---|---|---|---|---|
| 8,602,465 | B2 | 12/2013 | Holmgren | |
| 8,726,704 | B2 * | 5/2014 | White | A47B 88/60 70/63 |
| 9,307,797 | B2 | 4/2016 | Sánchez Giráldez | |
| D907,454 | S | 1/2021 | Marsden | |
| D907,460 | S | 1/2021 | Marsden | |
| D907,461 | S | 1/2021 | Marsden | |
| 2006/0042334 | A1 * | 3/2006 | Huang | E05B 47/0002 70/279.1 |
| 2012/0067090 | A1 * | 3/2012 | Varney | E05B 65/46 70/81 |
| 2017/0335604 | A1 * | 11/2017 | Liang | E05B 47/00 |
| 2018/0363328 | A1 * | 12/2018 | Huang | E05B 47/004 |
| 2019/0257121 | A1 * | 8/2019 | Tubby | E05B 65/44 |

FOREIGN PATENT DOCUMENTS

| | | | | | |
|---|---|---|---|---|---|
| EP | 0 916 792 | A2 | | 5/1999 | |
| GB | 2145461 | A | * | 3/1985 | E05B 47/004 |
| KR | 20100050897 | A | * | 1/2013 | E05B 47/004 |

OTHER PUBLICATIONS

International Search Report and Written Opinion for International Application No. PCT/US2020/051298, dated Dec. 30, 2020.

U.S. Appl. No. 29/706,204, filed Sep. 18, 2019, Marsden.

U.S. Appl. No. 29/706,185, filed Sep. 18, 2019, Marsden.

U.S. Appl. No. 29/706,186, filed Sep. 18, 2019, Marsden.

[No Author Listed] Product Listing for Safety 1st Extra Key for Adhesive Magnetic Lock System with 1 Key, 2 Locks. Amazon.com. https://www.amazon.com/Safety-1st-Adhesive-Magnetic-System/dp/B076QCR4ND/ref=sr_1_5_s_it?s=baby-product&ie=UTFS&qid=1521217493&sr=1-5&keywords=safety%2B1st%2Bmagentic%2Block&th=1, last accessed Mar. 20, 2020, 10 pages.

[No Author Listed] Product Listing for Safety 1st Magnetic Locking System Starter Set (2 Locks, 1 Key). Amazon.com. https://www.amazon.com/Safety-1st-Magentic-Locking-Starter/dp/B0000488W1/ref=sr_1_7_s_it?s=baby-products&ie=UTF8&qid=1521217815&sr=1-7&keywords=safety+1st+magnetic+lock, last accessed Mar. 20, 2020, 8 pages.

* cited by examiner

MAGNET RESPONSIVE CABINET LOCK

FIELD

Disclosed embodiments are related to cabinet locks and related methods of use.

BACKGROUND

Cabinet locks are commonly employed on cabinets that may be easily reachable by small children. Such cabinet locks typically employ a key or some other type of dual-action motion to inhibit a child from accessing the cabinet. Cabinet locks are typically installed inside of a cabinet door, and engage a corresponding catch on a stationary cabinet wall.

SUMMARY

In some embodiments, a cabinet lock includes a housing, a latch disposed at least partially in the housing and configured to translate between an extended position and a retracted position, and a lever disposed in the housing. The lever includes a first pivot fixed to the housing and configured to allow the lever to rotate relative to the housing between an engaged position and a disengaged position, a second pivot coupling the lever to the latch, where when the lever moves toward the engaged position the latch is translated toward the retracted position, and where when the lever moves toward the disengaged position, the latch is translated toward the extended position, and a ferromagnetic portion configured to move the lever from the disengaged position toward the engaged position when a magnet is within a threshold distance of the lever.

In some embodiments, a cabinet lock includes a housing, a latch disposed at least partially in the housing and configured to translate between an extended position and a retracted position, where the latch includes a latch engagement face inclined at an acute angle relative to a direction in which the latch translates, and a lever. The lever includes a first pivot fixed to the housing and configured to allow the lever to rotate relative to the housing between an engaged position and a disengaged position, a second pivot coupling the lever to the latch, where when the lever moves toward the engaged position the latch is translated toward the retracted position, and where when the lever moves toward the disengaged position, the latch is translated toward the extended position, and a ferromagnetic portion configured to move the lever from the disengaged position toward the engaged position when a magnet is within a threshold distance of the lever. The cabinet lock also includes a catch including a catch engagement face, where the catch engagement face is configured to engage the latch engagement face, and where the catch engagement face is parallel to the latch engagement face.

In some embodiments, a method of operating a cabinet lock includes installing a cabinet lock housing on a first portion of a cabinet, installing a catch on a second portion of the cabinet, moving a latch of the cabinet lock into an extended position where the latch extends from the housing and where the latch is configured to engage the catch when the first portion and second portion of the cabinet are moved relative to one another, moving a magnet within a threshold distance of a lever disposed in the housing, thereby rotating the lever about a first pivot, and translating the latch from the extended position to a retracted position via a second pivot which rotatably couples the lever to the latch. When the latch is in the retracted position the latch clears the catch when the first portion and second portion of the cabinet are moved relative to one another.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
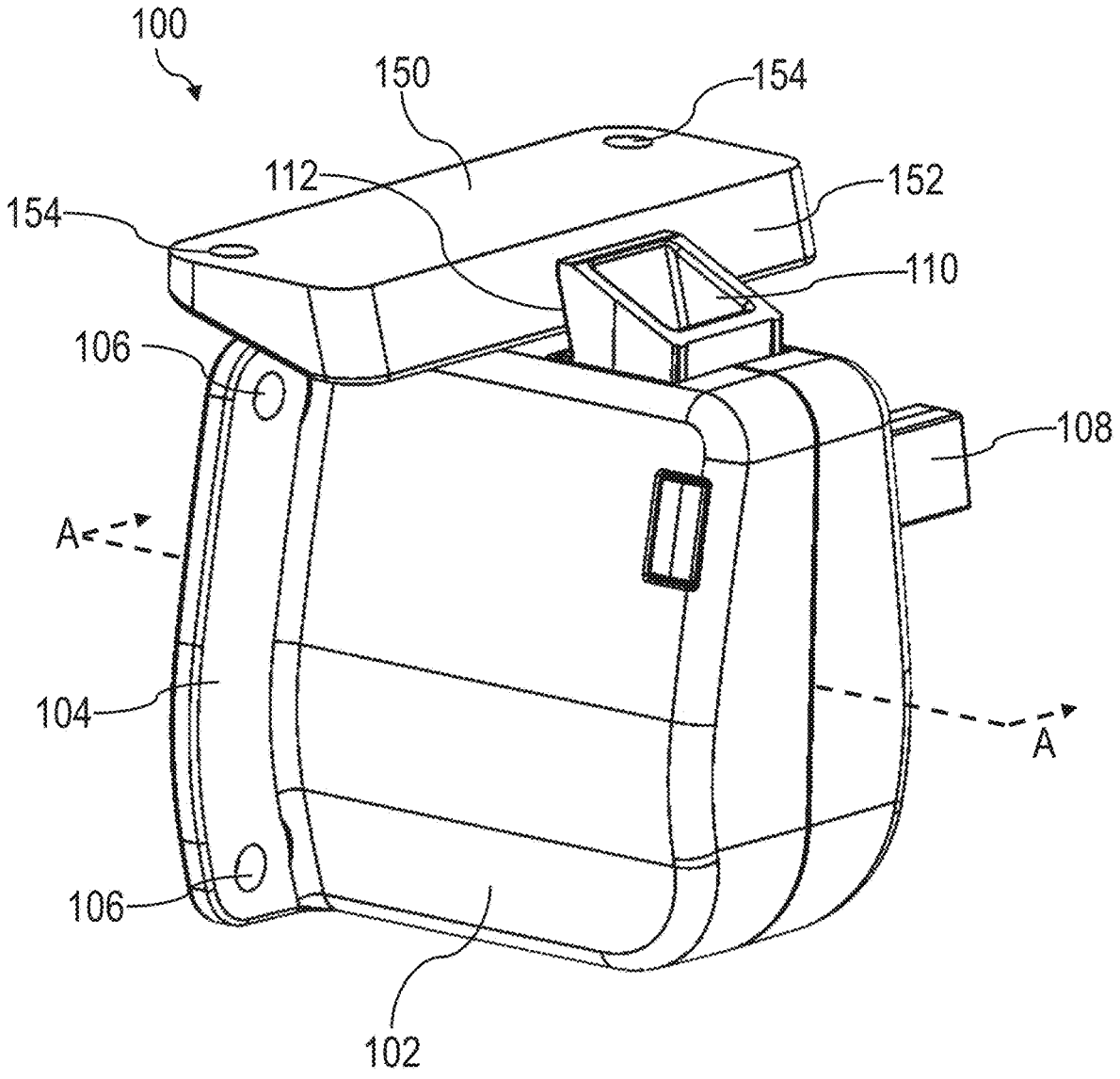
FIG. 1 is a perspective view of one embodiment of a cabinet lock.

Child cabinet locks are typically employed on cabinets within reach of small children to prevent children from gaining access to the contents of the cabinet. Typically, such cabinet locks employ a dual-action mechanism or keyed arrangement which allows an adult to operate the cabinet lock while inhibiting a child from doing the same. Conventionally, magnetic cabinet locks have been employed where a magnetic key permits a cabinet lock to be easily opened by the key holder, while preventing access to the cabinet by a child who does not have the key. In the operation of such cabinet locks, a magnet (e.g., a key magnet) is placed within a threshold distance of the cabinet lock, and the key magnet applies a magnetic force to a corresponding magnet or ferromagnetic portion of the cabinet lock. The force application in turn operates a mechanism that moves a latch to a retracted position, thereby unlocking the cabinet.

The mechanisms employed in some cabinet locks are complex multi-bar linkages which may be susceptible to high frictional loads or jamming when moving to a retracted position. Additionally, conventional latches employed in cabinet locks rotate between positions (e.g., an extended position and retracted position.) Further, many conventional latches have a curved engagement face. Such latches may be susceptible to being bypassed when excessive force applied to a cabinet door.

In view of the above, the inventor has recognized the benefits of a cabinet lock with two moving components that yield reduced frictional loads on the cabinet lock: a rotating lever and a translating catch. Because the latch translates between extended and retracted positions, the cabinet lock is better able to resist large forces. Additionally, the inventor has recognized the benefits of a latch engagement face that is flat and angled at an acute angle relative to a direction of translation of the latch. Such an arrangement may cause force applied to a cabinet door to move the latch further into the extended position, thereby resisting opening from large forces.

In some embodiments, a cabinet lock includes a cabinet lock housing in which a latch and a lever are at least partially disposed in the housing. The latch is constrained by the housing to translate between an extended position and a retracted position, where the latch projects further from the housing when the latch is in the extended position as compared to the retracted position.

Arranging the latch to translate instead of purely rotating may permit the latch engagement face to maintain its same orientation regardless of the extent of the extension/retraction of the latch. In this manner, the latch engagement face may maintain full surface contact with abutting portions of the catch engagement face. A latch which purely rotates will change its engagement face angle orientation relative to a corresponding catch face, and could reduce contact surface area, or require curved surfaces to maintain contact surface area. According to some embodiments disclosed herein, a partially retracted latch may still be able to prevent opening of the cabinet door because the latch face and catch face have the same relative orientation as when the latch is fully extended. In combination with an angled latch engagement face and an angled catch engagement face, the translational movement of the latch may permit consistent contact surface area without using curved surfaces. And the angled engagement faces may pull the latch outwardly toward a more fully extended position when the cabinet door is pulled in an opening direction and the partially extended latch contacts the catch.

The lever is coupled to the housing via a first pivot which allows the lever to rotate between an engaged position and a disengaged position. On a first end of the lever is disposed a ferromagnetic portion which is responsive to a magnet placed in proximity of the cabinet lock. On an opposite second end of the lever is a second pivot rotatably coupling the latch to the lever such that rotation of the lever between the engaged and disengaged positions moves the latch between the retracted and extended positions, respectively.

In some embodiments, the second pivot may be formed by a pin attached to, or integrally formed with, the latch disposed within a slot in the lever. When a magnet is placed within a threshold distance from the ferromagnetic portion, the lever may rotate from the disengaged position toward the engaged position, thereby moving the latch from the extended position toward the retracted position via the second pivot. Such an arrangement may provide a simple, reliable motion of the latch between the extended and retracted positions in response to a magnetic key.

In some embodiments, a cabinet lock latch includes a latch engagement face that corresponds to a catch engagement face. That is, the latch engagement face and catch engagement face may be correspondingly shaped such that engagement between the latch engagement face and the catch engagement face does not urge the latch from an extended position to a retracted position. In some embodiments, the latch engagement face is a continuous (e.g., flat) face that is inclined at an acute angled relative to a direction of translation (i.e., a direction of extension) of the latch. The catch engagement face may be correspondingly angled, such that the catch engagement face is parallel with the latch engagement face. In such an arrangement, when the latch engagement face engages the catch engagement face, the latch may be urged toward the extended position via the normal forces associated with the latch engagement face. As a result, the latch may be resistant to large forces, as the force applied to the latch may never urge the latch toward a retracted position.

In some embodiments, the latch and catch engagement faces may also be free from projections, shelves, or hooks that would otherwise interfere with the movement of the latch between the extended position and retracted position. That is, according to exemplary embodiments described herein, a latch with an acutely angled engagement face may still be able to move toward the retracted position when an opening force is applied via a magnetic key even when some amount of force is being applied to the latch and/or catch.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a perspective view of one embodiment of a cabinet lock 100. As shown in FIG. 1, the cabinet lock includes a housing 102 configured to be mounted to a first portion of a cabinet (e.g., a cabinet door). The housing includes a mounting flange 104 having a plurality of mounting holes 106 each configured to receive a fastener (e.g., screws) and secure the housing to the first portion of the cabinet. The cabinet lock 100 also includes a latch 110, as well as a lockout 108 disposed partially in the housing 102.

As will be described further below, the latch 110 is configured to translate between an extended position as shown in FIG. 1 and a retracted position (for example, see FIG. 5). The latch includes a latch engagement face 112 configured to engage a catch 150 of the cabinet lock, and, in particular, a catch engagement face 152. The lockout 108 is configured to move the latch into and/or maintain the latch 110 in the retracted position, as will be discussed further with reference to FIGS. 6-7. As shown in FIG. 1, the catch 150 is configured to be mounted to a second portion of a cabinet (e.g., a cabinet wall) via two mounting holes 154, which are configured to receive fasteners (e.g., screws).

Figure 2:
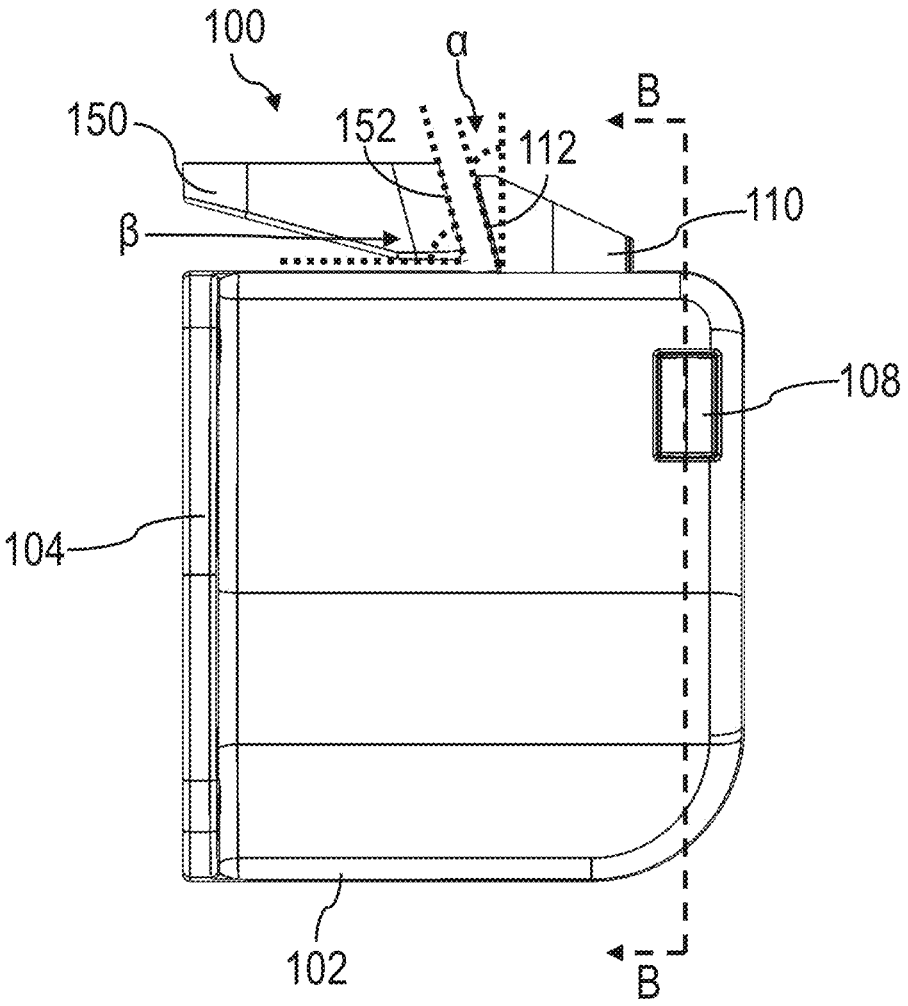
FIG. 2 is side view of the cabinet lock of FIG. 1.

FIG. 2 is side view of the cabinet lock 100 of FIG. 1 better showing the latch engagement face 12 and the catch engagement face 152. As noted above, the latch 110 is configured to translate (e.g., move linearly) between retracted and extended positions. The latch engagement face 112 is angled acutely relative to a direction of extension of the latch 110. That is, the angle $\alpha$ is less than 90° and greater than 0°, such that the latch engagement face is angled toward the catch 150. In the particular embodiment shown in FIG. 2, the latch engagement face is angled at approximately 15° relative to the direction of extension of the latch 110. Of course, in other embodiments, any suitable angle may be employed, including, but not limited to 5°, 10°, 20°, 30°, 45°, and 60°. The catch engagement face 152 is angled such that it is parallel to the latch engagement face 112. That is, relative to the cabinet wall on which the catch 150 may be mounted (e.g., a horizontal wall), the catch engagement face is angled at an angle $\beta$ which is also acute (e.g., $0° < \beta < 90°$. In the particular embodiment of FIG. 2, the angle $\beta$ is approximately 75°, and forms a complementary angle with angle $\alpha$ such that the combined angle formed by $\alpha$ and $\beta$ is approximately 90°.

As noted above, the angles of the latch engagement face 112 and catch engagement face 152 are configured such that when they are engaged, the normal forces between the faces urge the latch toward the extended position. That is, when the latch contacts the catch, the angle of the engagement faces yields a normal force component in the direction of extension of the latch 110, thereby urging the latch 110 toward the extended position and avoiding disengagement of the latch from the catch when force is applied to the cabinet lock 100.

Figure 3:
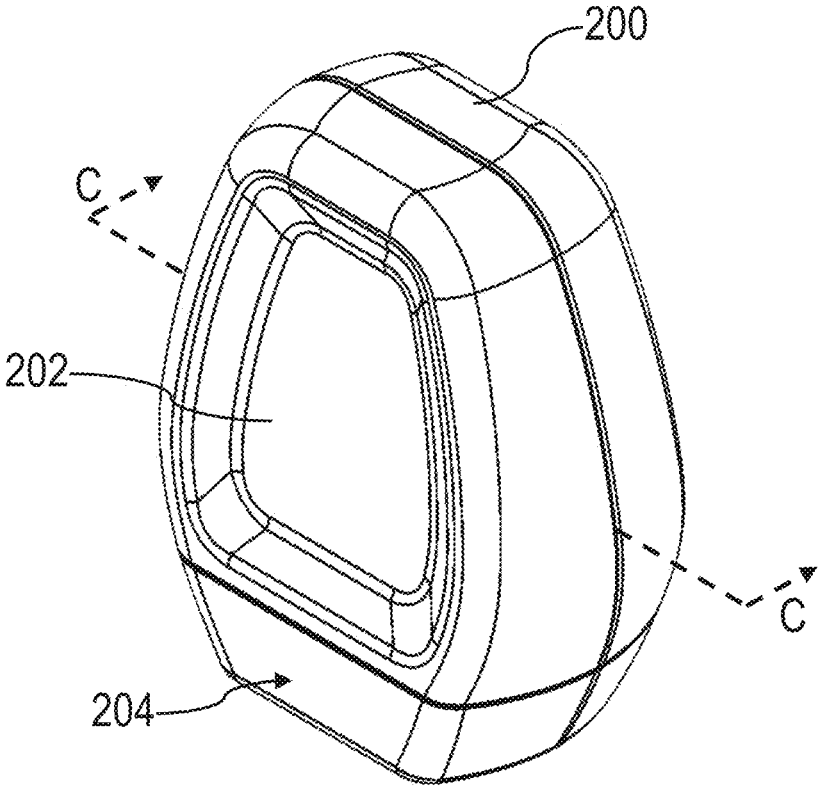
FIG. 3 is a perspective view of one embodiment of a cabinet lock key.

FIG. 3 is a perspective view of one embodiment of a cabinet lock key 200. According to the embodiment of FIG. 3, the cabinet lock key includes a housing 202 which contains a magnet in a magnetic end 204 of the cabinet lock key. When the cabinet lock key is moved within a threshold distance of an associated cabinet lock, a latch may be moved from an extended position toward a retracted position, as will be discussed further with reference to FIGS. 4-5.

Figure 4:
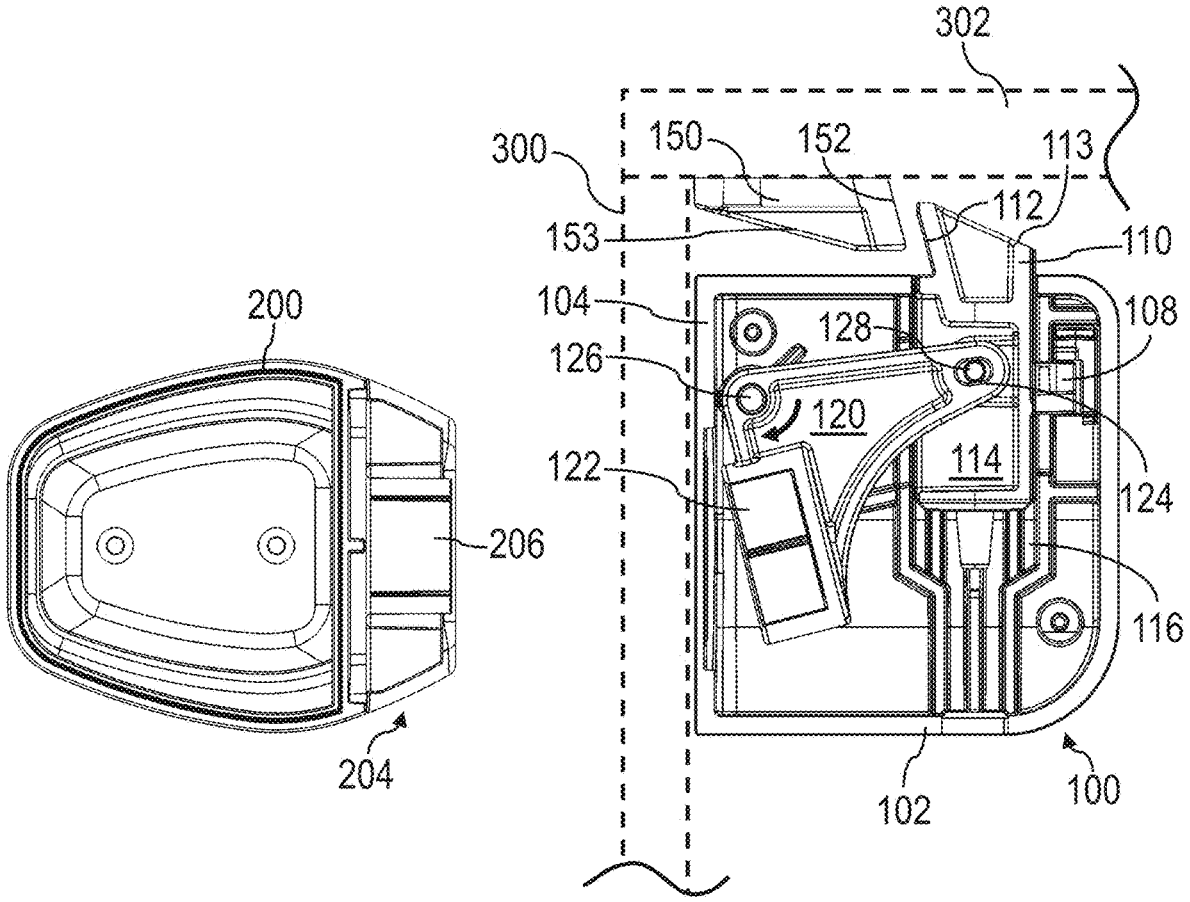
FIG. 4 is a side cross-sectional view of the cabinet lock of FIG. 1 taken along line A-A, and the cabinet lock key of FIG. 3 taken along line C-C, in a first configuration.

FIG. 4 is a side cross-sectional view of the cabinet lock 100 of FIG. 1 taken along line A-A, and the cabinet lock key 200 of FIG. 3 taken along line C-C in a first configuration. According to the configuration of FIG. 4, the cabinet lock key 200 is positioned at a distance greater than a threshold distance from the cabinet lock 100. Accordingly, a magnet 206 disposed in the cabinet lock key does not produce a sufficiently strong magnetic field at the cabinet lock 100 to cause the cabinet lock to change states.

As shown in FIG. 4, the housing 102 of the cabinet lock is attached to a first portion 300 of a cabinet, which in some embodiments may be a cabinet door. The catch 150 is secured to a second portion 302 of the cabinet (e.g., a horizontal cabinet wall). As shown in FIG. 4, the latch 110 is in an extended position. As a result, if the first portion of the cabinet 300 is moved relative to the second portion 302, the latch engagement face 112 is configured to engage the catch engagement face 152 to inhibit that relative movement. As discussed further below, when the key 200 is moved within a threshold distance of the cabinet lock 100, the latch is moved toward a retracted position such that the latch clears the catch and the first cabinet portion (e.g., cabinet door) may be moved freely relative to the second cabinet portion (e.g., cabinet wall).

As shown in FIG. 4, the latch 110 includes a latch body 114 disposed within a latch slot 116 formed in the housing 102. The latch body is configured to slide inside of the latch slot 116, and the latch slot 116 constrains the latch to move linearly between retracted and extended positions. The cabinet lock also includes a lever 120 configured to rotate between an engaged position (e.g., first rotational position in which magnet 206 has rotated lever 120) and a disengaged position (e.g., second rotational position). In the configuration shown in FIG. 4, the lever is in the disengaged position which corresponds to the latch being in the extended position.

As shown in FIG. 4, the lever 120 is coupled to the housing 102 via a first pivot 126, which allows the lever to rotate relative to the housing about the first pivot. A ferromagnetic portion 122 (e.g., magnet) of the lever is disposed on a first end of the lever and is arranged closest to the first cabinet portion 300. On the opposite end of the lever is a lever slot 124 configured to capture and rotatably link the lever to the latch 110. In particular, the latch body includes a pin 128 which is captured within the lever slot 124, the pin 128 and lever slot 124 forming a second pivot. Accordingly, when the lever 112 rotates between the disengaged position and the engaged position, the latch 110 correspondingly translates within the latch slot 116.

According to the embodiment of FIG. 4, the lever slot 124 is oblong and allows the pin 128 to slide within the lever 124. As the latch 112 is constrained to move linearly within the latch slot 116 and the lever slot 124 rotates in an arc, rotation of the lever 120 causes the pin 128 to slide along the lever slot 124. Without the tolerance to move, the pin may jam against the slot 124 and inhibit rotation of the lever (or correspondingly translation of the latch). Thus, in the embodiment of FIG. 4, the lever slot 124 is oblong and capped or closed on both ends, which allows the pin 128 to slide while the pin remains wholly captured within the lever slot. Of course, in some embodiments, the lever 120 may include a pin while the latch 110 includes a lever slot configured to capture the pin, as the present disclosure is not so limited. According to this embodiment, the lever slot formed in the latch may be oblong and closed on both ends to accommodate the lateral motion of the pin associated with the lever as the lever rotates between the engaged and disengaged positions.

Of course, in other embodiments the latch 112 may not be constrained to move only linearly in and out of the housing, and may additionally shift in a latch slot 116 sized and shaped to accommodate the lateral movement of the latch 112 and lever 120 link. In such embodiments, the latch may translate in two directions: extension or retraction relative to the housing 102, and a lateral direction toward or away from the first pivot 126. In some cases, such a two part motion may be desirable, as the latch may move away from the catch 152 (e.g., toward the right in FIGS. 4-5) as the latch is moved toward a retracted position. Accordingly, the latch may avoid jamming on the catch or otherwise reduce friction, while the latch engagement face 112 is still able to resist large forces on the cabinet door by urging the latch toward the extended position (or, put alternatively, urging the latch out from the housing 102).

In some embodiments, the cabinet lock 100 includes a biasing member (e.g., a compression spring, torsion spring, etc.) configured to urge the cabinet lock to the configuration show in FIG. 4, where the latch is in the engaged position and the lever is in the disengaged position. For example, in one embodiment, a torsion spring may be disposed about pivot 126 configured to urge the lever 120 to rotate toward the disengaged position. As another example, a compression spring may be disposed in the latch slot 116 that is configured to urge the latch body 114 toward the extended position. Of course, any suitable biasing member or combination of biasing members may be employed, as the present disclosure is not so limited.

From the configuration shown in FIG. 4, the cabinet lock key 200 may be moved closer to the cabinet lock 100 until the magnet 206 is within a threshold distance of the ferromagnetic portion 122. When the magnet is within the threshold distance, the magnet 206 may apply a force to the ferromagnetic portion, thereby generating a torque on the lever 120 shown by the curved arrow. Accordingly, the lever may rotate toward the engaged position (e.g., clockwise relative to the page), thereby moving the latch 122 from the extended position toward the retracted position. The retracted position and engaged position are shown in FIG. 5, as discussed below.

Figure 5:
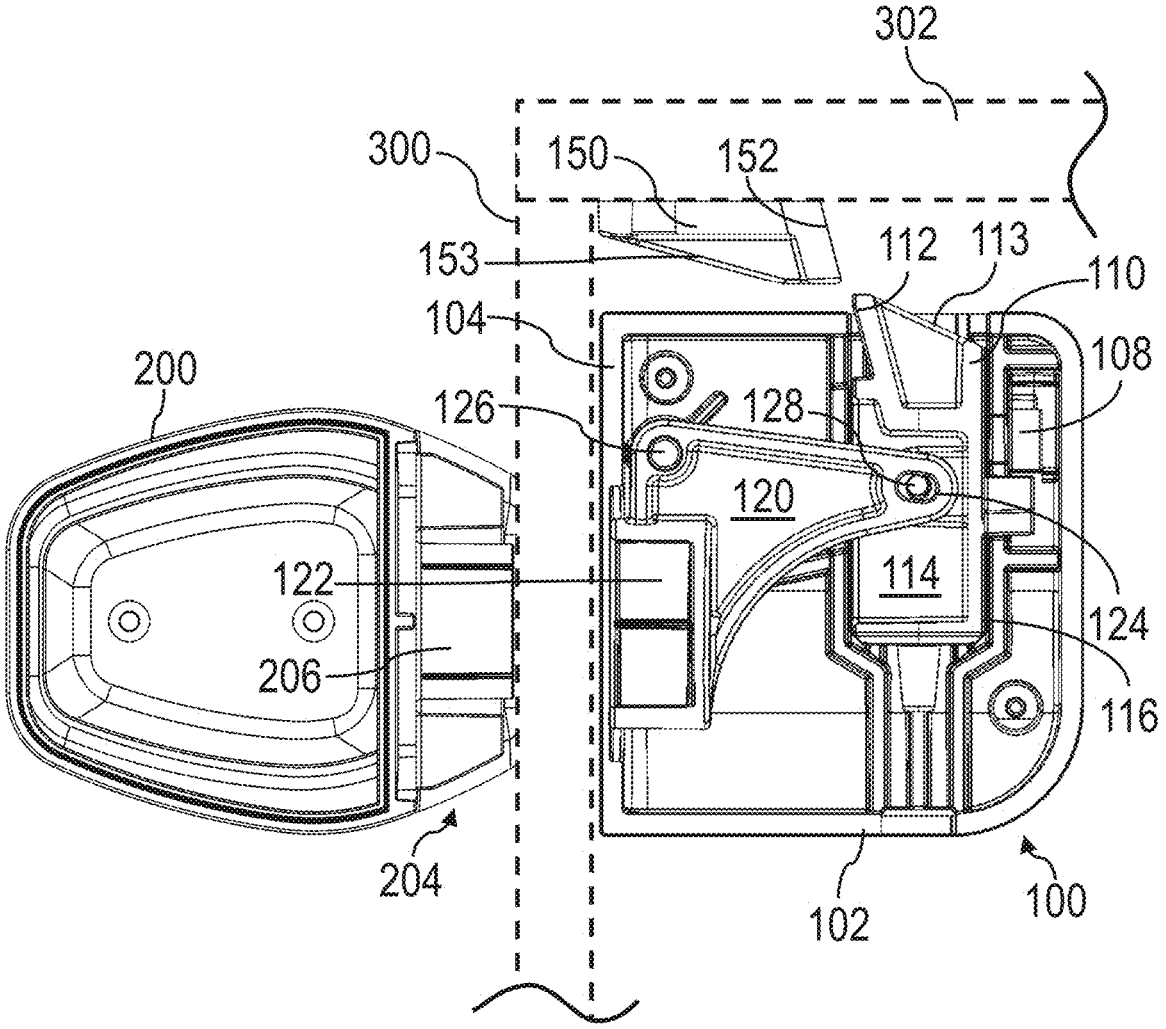
FIG. 5 is a side cross-sectional view of the cabinet lock of FIG. 1 taken along line A-A, and the cabinet lock key of FIG. 3 taken along line C-C, in a second configuration.

FIG. 5 is a side cross-sectional view of the cabinet lock 100 of FIG. 1 taken along line A-A, and the cabinet lock key 200 of FIG. 3 taken along line C-C in a second configuration. As shown in FIG. 5, the lever 120 is in an engaged position where the ferromagnetic portion 122 is positioned against the housing 102. The ferromagnetic portion is urged toward the cabinet lock key 200 as the magnetic field from the magnet 206 applies a force on the ferromagnetic portion 122. According to the embodiment of FIG. 5, the magnet 206 may be within a threshold distance when the cabinet lock housing 204 is positioned against the first cabinet portion 300 (e.g., a cabinet door). Of course, in some embodiments, the threshold distance may be greater than contact with the first cabinet portion to provide for compatibility with a variety of different cabinet thicknesses, as the present disclosure is not so limited. As shown in FIG. 5, the latch 110 is in a retracted position where the latch engagement face clears the catch engagement face 152. Accordingly, the cabinet portions 300, 302 may be moved relative to one another (e.g., a cabinet door may be opened).

According to the embodiment shown in FIGS. 4 and 5, the latch includes an inclined strike 113 and the catch includes a corresponding catch strike 153. The latch strike and catch strike are configured to allow the latch 110 to pass the catch 150 in a first direction, while movement in the opposite direction is inhibited by the latch engagement face 112 and catch engagement face 152. That is, if the first portion 300 of the cabinet is a cabinet door and the cabinet door is open, movement of the cabinet door to a closed position may cause the latch strike to contact the catch strike 153. As the latch strike is angled, the resulting normal force may urge the latch toward the retracted position, such that the latch may pass the catch. Once the latch is past the catch 150, the latch may be urged toward the extended position (e.g., via a biasing member as described above), thereby securing the first cabinet portion 300 relative to the second cabinet portion. Such an arrangement may allow a cabinet door or drawer to be closed without the presence of the cabinet lock key 200.

Figure 6:
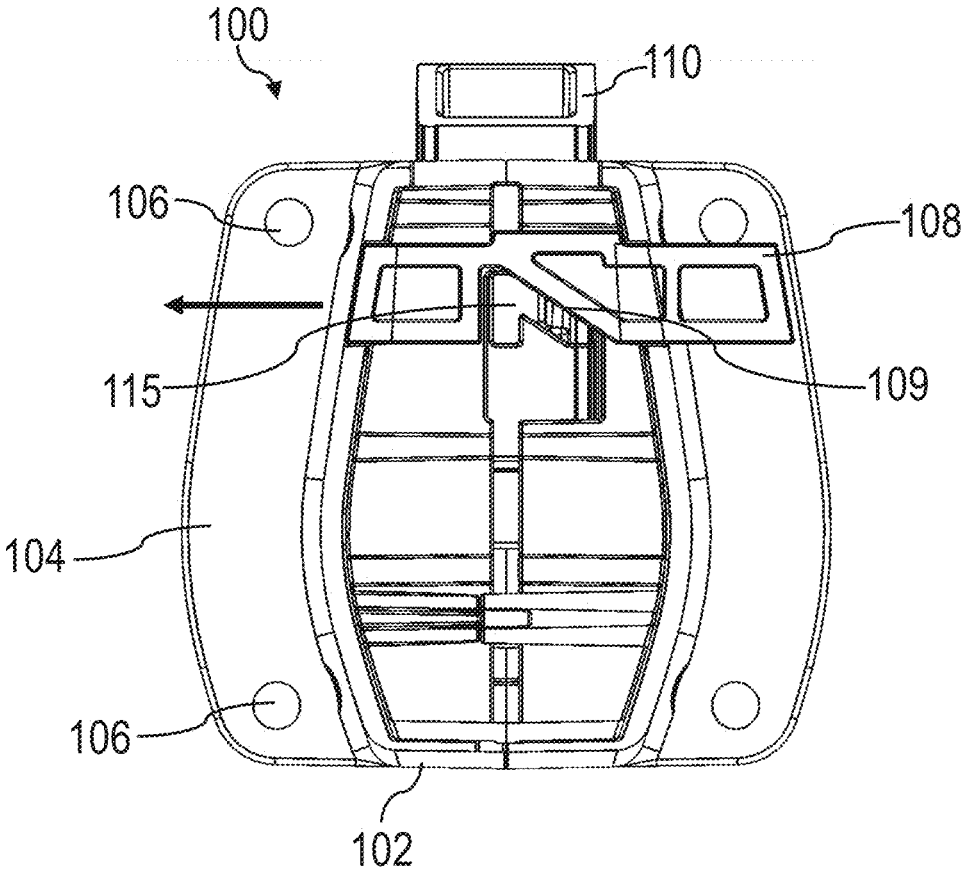
FIG. 6 is a front cross-sectional view of the cabinet lock of FIG. 2 taken along line B-B, in a first configuration.
Figure 7:
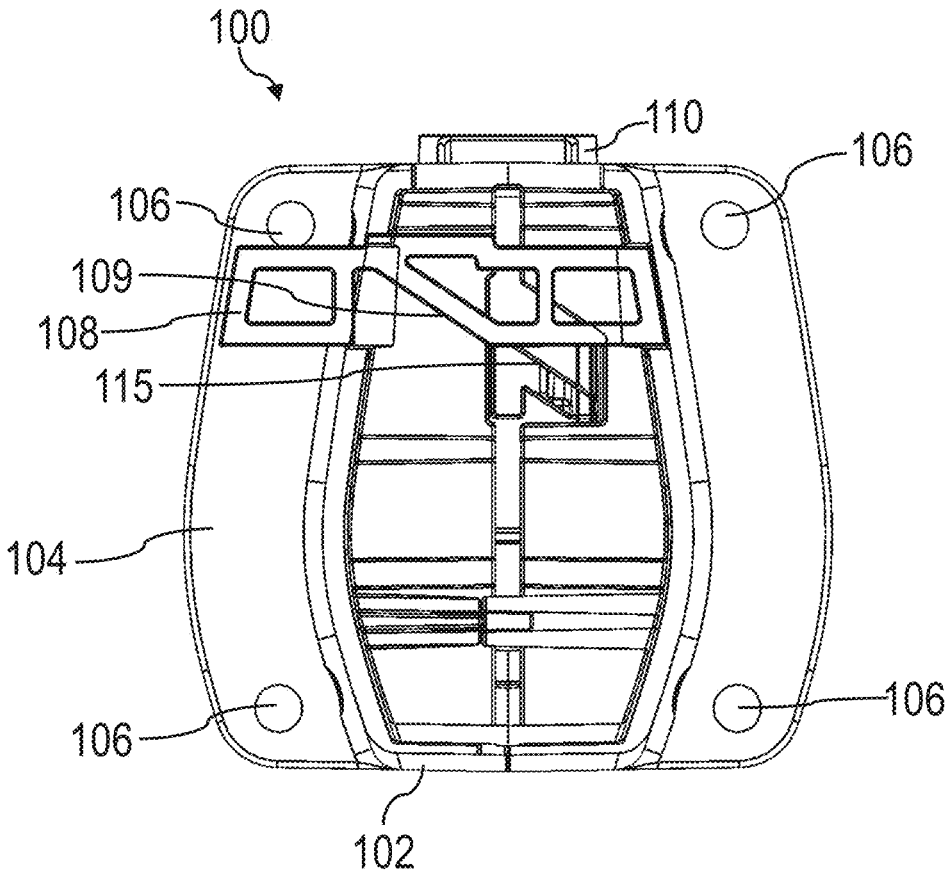
FIG. 7 is another front cross-sectional view of the cabinet lock of FIG. 2 taken along line B-B, in a second configuration.

FIGS. 6-7 depict side cross-sectional views of the cabinet lock 100 of FIG. 2 taken along line B-B in a first configuration and a second configuration, respectively, showing the functionality of the lockout 108. As shown in FIG. 6, the lockout is configured as a switch which is partially disposed in the housing 102. The lockout is configured to slide between an unlocked position (shown in FIG. 6) and a locked position (shown in FIG. 7). In the unlocked position, the lockout does not affect the movement of the latch 110 between extended and retracted positions. However, in the locked position, the lockout maintains the latch 110 in the retracted position. In particular, as shown in FIG. 7, the lockout is configured to engage a lockout tab 115 formed as a part of the latch 110, which inhibits the latch from moving toward the extended position. Accordingly, the lockout may maintain the latch in the retracted position against any biasing force, thereby allowing a cabinet or drawer to operate normally as if the cabinet lock was not installed.

According to the embodiment of FIGS. 6-7, the lockout 108 is also configured to move the latch from the extended position to the retracted position. As shown in FIG. 6, the lockout includes a contact ramp 109 that engages the lockout tab 115 formed on the latch 110. Both the contact ramp and lockout tab are correspondingly angled, such that sliding the lockout from the unlocked position to the locked position applies a force moving the latch from the extended position toward the retracted position. That is, as the catch ramp slides along the lockout tab, the latch is moved to the retracted position shown in FIG. 7. Accordingly, locking out the cabinet lock merely requires sliding the lockout, which may be performed without the presence of the corresponding cabinet lock key.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A cabinet lock, comprising:

a housing;

a latch disposed at least partially in the housing and configured to translate between an extended position and a retracted position, wherein the latch includes a latch engagement face configured to engage a catch that is inclined at an acute angle relative to a direction in which the latch translates, and wherein the latch engagement face is configured to urge the latch toward the extended position when engaged with the catch;

a lever disposed in the housing including:

a first pivot fixed to the housing and configured to allow the lever to rotate relative to the housing between an engaged position and a disengaged position, a second pivot coupling the lever to the latch, wherein when the lever moves toward the engaged position the latch is translated toward the retracted position, and wherein when the lever moves toward the disengaged position the latch is translated toward the extended position, and a ferromagnetic portion configured to move the lever from the disengaged position to the engaged position when a magnet is within a threshold distance of the lever;

a lockout slider configured to move the latch into the retracted position and maintain the latch in the retracted position, wherein the lockout slider is configured to slide linearly between an unlocked position and a locked position, wherein the lockout slider does not affect movement of the latch between the extended position and the retracted position in the unlocked position, wherein the lockout slider maintains the latch in the retracted position in the locked position, and wherein the lockout slider includes a contact ramp angled relative to a direction in which the lockout slider slides; and a lockout tab in the locked position to inhibit the latch from moving toward the lockout tab when the lockout slider slides from the unlocked position to the locked position to move the latch from the extended position toward the retracted position.

2. The cabinet lock of claim 1, wherein the second pivot includes a slot and pin arrangement.

3. The cabinet lock of claim 1, wherein the second pivot includes a slot formed in the lever and a pin coupled to the latch, wherein the pin is disposed in the slot.

4. The cabinet lock of claim 3, wherein the slot is oblong and allows the pin to slide in the slot.

5. The cabinet lock of claim 3, wherein the slot is closed on both ends.

6. The cabinet lock of claim 1, wherein the latch includes a latch engagement face is inclined toward the catch.

7. The cabinet lock of claim 1, wherein the ferromagnetic portion is magnetic.

8. The cabinet lock of claim 1 further comprising the catch including a catch engagement face, wherein the catch engagement face is configured to engage the latch engagement face, and wherein the catch engagement face is parallel to the latch engagement face.

9. The cabinet lock of claim 8, wherein the catch engagement face extends continuously without projections, shelves, or hooks.

10. The cabinet lock of claim 1, wherein the ferromagnetic portion of the lever is magnetically attracted to the magnet within the threshold distance.

11. The cabinet lock of claim 1, wherein the lockout slider is configured to slide in a direction transverse to the direction in which the latch translates.

12. A cabinet lock, comprising:

a housing;

a latch disposed at least partially in the housing and configured to translate between an extended position and a retracted position, wherein the latch includes a latch engagement face inclined at an acute angle relative to a direction in which the latch translates;

a lever including:

a first pivot fixed to the housing and configured to allow the lever to rotate relative to the housing between an engaged position and a disengaged position, a second pivot coupling the lever to the latch, wherein when the lever moves toward the engaged position the latch is translated toward the retracted position, and wherein when the lever moves toward the disengaged position the latch is translated toward the extended position, and a ferromagnetic portion configured to move the lever from the disengaged position to the engaged position when a magnet is within a threshold distance of the lever;

a catch including a catch engagement face, wherein the catch engagement face is configured to engage the latch engagement face, wherein the catch engagement face is parallel to the latch engagement face, and wherein the latch engagement face is configured to urge the latch toward the extended position when engaged with the catch engagement face;

a lockout slider configured to move the latch into the retracted position and maintain the latch in the retracted position, wherein the lockout slider is configured to slide linearly between an unlocked position and a locked position, wherein the lockout slider does not affect movement of the latch between the extended position and the retracted position in the unlocked position, wherein the lockout slider maintains the latch in the retracted position in the locked position, and wherein the lockout slider includes a contact ramp angled relative to a direction in which the lockout slider slides; and a lockout tab formed as part of the latch, wherein the lockout slider is configured to engage the lockout tab in the locked position to inhibit the latch from moving toward the extended position, and wherein the contact ramp is configured to apply a force to the lockout tab when the lockout slider slides from the unlocked position to the locked position to move the latch from the extended position toward the retracted position.

13. The cabinet lock of claim 12, wherein the second pivot includes a slot and pin arrangement.

14. The cabinet lock of claim 12, wherein the second pivot includes a slot formed in the lever and a pin coupled to the latch, wherein the pin is disposed in the slot.

15. The cabinet lock of claim 14, wherein the slot is oblong and allows the pin to slide in the slot.

16. The cabinet lock of claim 14, wherein the slot is closed on both ends.

17. The cabinet lock of claim 14, wherein the ferromagnetic portion is magnetic.

18. The cabinet lock of claim 14, wherein the catch engagement face extends continuously without projections, shelves, or hooks.

19. The cabinet lock of claim 12, wherein the ferromagnetic portion of the lever is magnetically attracted to the magnet within the threshold distance.

20. The cabinet lock of claim 12, wherein the lockout slider is configured to slide in a direction transverse to the direction in which the latch translates.

21. A method of operating a cabinet lock, comprising:

installing a cabinet lock housing on a first portion of a cabinet;

installing a catch on a second portion of the cabinet;

moving a latch of the cabinet lock into an extended position where the latch extends from the cabinet lock housing and where the latch includes a latch engagement face configured to engage the catch when the first portion and the second portion of the cabinet are moved relative to one another, wherein the latch engagement face is inclined at an acute angle relative to a direction in which the latch linearly translates, and is configured to urge the latch toward the extended position when engaged with the catch;

moving a magnet within a threshold distance of a lever disposed in the cabinet lock housing, thereby rotating the lever about a first pivot;

linearly translating the latch from the extended position to a retracted position via a second pivot which rotatably couples the lever to the latch, wherein when the latch is in the retracted position the latch engagement face clears the catch when the first portion and second portion of the cabinet are moved relative to one another;

sliding a lockout slider linearly from an unlocked position to a locked position, wherein the lockout slider is configured to move the latch into the retracted position and maintain the latch in the retracted position, wherein the lockout slider does not affect movement of the latch between the extended position and the retracted position in the unlocked position, wherein the lockout slider maintains the latch in the retracted position in the locked position; and wherein the lockout slider includes a contact ramp angled relative to a direction in which the lockout slider slides; and engaging a lockout tab, formed as part of the latch, with the contact ramp as the lockout slider slides to the locked position, wherein the lockout slider is configured to engage the lockout tab in the locked position to inhibit the latch from moving toward the extended position, and wherein the contact ramp is configured to apply a force to the lockout tab when the lockout slider slides from the unlocked position to the locked position to move the latch from the extended position toward the retracted position.

22. The method of claim 21, wherein the second pivot includes a slot and pin arrangement.

23. The method of claim 21, wherein the second pivot includes a slot formed in the lever and a pin coupled to the latch, wherein the pin is disposed in the slot.

24. The cabinet lock of claim 21, wherein the catch includes a catch engagement face parallel to the latch engagement face when the latch is engaged with the catch.

25. The method of claim 21, wherein the magnet magnetically attracts the lever within the threshold distance, thereby rotating the lever about the first pivot.

26. The method of claim 21, wherein sliding the lockout slider linearly comprises sliding the lockout slider in a direction transverse to the direction in which the latch translates.

* * * * *